US006083374A

United States Patent [19]

Kopp

[11] Patent Number: 6,083,374

[45] Date of Patent: Jul. 4, 2000

[54] PROCESS FOR MAINTAINING A CONSTANT CONCENTRATION OF SUBSTANCES IN AN ELECTROPLATING BATH

[75] Inventor: Lorenz Kopp, Altdorf, Germany

[73] Assignee: Atotech Deutschland GmbH, Berlin, Germany

[21] Appl. No.: 09/091,560

[22] PCT Filed: Jan. 10, 1997

[86] PCT No.: PCT/EP97/00097

§ 371 Date: Jun. 18, 1998

§ 102(e) Date: Jun. 18, 1998

[87] PCT Pub. No.: WO97/25456

PCT Pub. Date: Jul. 17, 1997

[30] Foreign Application Priority Data

Jan. 12, 1996 [DE] Germany ..... 196 00 857

[51] Int. Cl.[7] ..... C25D 21/14

[52] U.S. Cl. ..... 205/101; 205/82; 205/335; 205/641; 205/673; 205/687

[58] Field of Search ..... 205/81, 82, 83, 205/84, 101, 335, 641, 645, 650, 673, 687

[56] References Cited

U.S. PATENT DOCUMENTS

| | | | |
|---|---|---|---|
| 5,352,350 | 10/1994 | Andricacos et al. | 205/101 |
| 5,376,256 | 12/1994 | Leutwyler | 205/99 |
| 5,858,196 | 1/1999 | Ikenaga | 205/82 |

FOREIGN PATENT DOCUMENTS

| | | |
|---|---|---|
| 0 552 128 A1 | 1/1993 | European Pat. Off. . |
| 40 15 141 | 11/1991 | Germany . |

OTHER PUBLICATIONS

Galvanotechnisches Fachwissen, Von einem Autorenkollektiv, Federfuhrung dr.–Ing. Alexander Strauch 1982 month of publication not available, pp. 436–441.

*Primary Examiner*—Kathryn Gorgos
*Assistant Examiner*—William T. Leader
*Attorney, Agent, or Firm*—Paul & Paul

[57] ABSTRACT

The invention relates to a method for maintaining constant concentrations of substances contained in an electrolytic treatment bath, preferably in baths with aqueous solutions. In order to regenerate the continual depletion of chemicals, substance concentrates are added to the baths according to known methods. The rapid increase in concentrations of damaging substances in the processing solution is disadvantageous. In order to reduce this build-up, a further metering method is known, namely the continuous replacement of bath solution by creating a bath overflow. The addition of bath solution with the bath concentration is balanced out by the overflow. As a consequence of evaporation and entrainment this method also leads to the fact that the operating concentration cannot be maintained for a long period of time in chemically critical baths. With the invention, this problem is resolved by continuous or intermittent removal of bath solution in a defined quantity and addition of fresh bath solution preferably in the same quantity. The changes in the concentrations of substances in the bath occurring through evaporation and entrainment are compensated for completely independently of the metering.

7 Claims, No Drawings

PROCESS FOR MAINTAINING A CONSTANT CONCENTRATION OF SUBSTANCES IN AN ELECTROPLATING BATH

SPECIFICATION

The invention relates to a method for maintaining constant concentrations of substances contained in an electrolytic treatment bath, preferably in baths with aqueous solutions. The method is universally applicable. A preferred area of application is represented by the metering of chemicals in electrolytic baths and other wet-chemical baths for producing circuit boards, preferably in horizontal throughput units.

The chemicals contained in the bath are constantly depleted in an electrolytic processing bath because of the treatment of the item to be treated. A depletion of this type can also result in an exclusively time-dependent way, for example in a treatment bath for electroless copper plating. In this case, strongly alkaline solutions are used at high temperatures, in which solutions the caustic alkali reacts to caustic alkali in a reaction with carbon dioxide in the air which is introduced into the treatment solution to stabilise the bath and is depleted in this way. The depletion of the process-specific substances must be regenerated in such a way that the respective chemical concentration in the processing bath is maintained within preset limits. The same is true also of the decomposition products of the substances arising during the treatment, said products frequently interfering with the treatment. Their concentrations must be maintained as far as possible beneath certain concentration limits.

The substances are normally regenerated automatically. For this purpose, two methods are known, namely the addition of concentrated solutions (concentrates) to the treatment bath and also continuous replacement of the liquid in the bath by providing a constant volume flow of fresh liquids and corresponding overflow of the bath.

When adding concentrates to the treatment bath the volume of measured quantities is set very small naturally enough since, in order to maintain concentrations of substances in the bath, only small supplements of concentrates suffice in comparison with the entire quantity in the bath. Hence the change in volume of the treatment liquid in the bath caused by these supplements need not be considered. Usually a portion of the treatment solution is evaporated also, especially at high treatment temperatures so that the loss of liquid by evaporation loss is compensated for by regenerating with concentrates. In this case therefore, only small amounts of liquid need to be handled. Furthermore, entrainment losses also occur in the bath, since the item to be treated removes a portion of the treatment solution when being removed from the treatment bath. Corresponding addition of the substances is counteracted, since the item to be treated is either inserted into the bath dry or is already moistened with another treatment solution or water from a rinsing bath, so that even in this case the substances lost through removal are not regenerated by a corresponding supplement.

Apart from depletion caused by the chemical reactions taking place in the treatment liquid and entrainment losses, all the substances remain in the processing bath upon regeneration with the treatment concentrates since the overflowing of the bath caused by a rapid increase in volume does not occur. This has the advantage that no fairly large quantities from the bath need to be disposed of. However it is disadvantageous that, when chemical concentrates are added, the concentration of the substances in the processing bath are constantly increased (build up). Baths, in which the composition for the treatment must be kept within narrow concentration limits, can hence only be pre-set in an insufficiently stable manner. An added complication may then occur when these baths are operated with a small bath volume and with a large throughput of items for treatment. This is the case in electrolytic production methods of circuit boards in horizontal throughput units for example. Because of the substances accumulating in the treatment solution and also because of the progressive ageing of the bath, baths of this type must repeatedly over short time spans, be completely rejected and renewed since the bath volumes are small in this case and, because of the large throughput quantity of items to be treated passing through the units, large amounts of substance for regeneration must be added. Because of this, loss of production frequently occurs. In addition, large quantities of depleted treatment solution must be disposed of in this case.

The publication DE 40 15 141 A1 describes how a continuous replacement of treatment liquid should avoid the disadvantages of adding concentrates. The depletion of chemicals is compensated for, according to this publication, by adding fresh bath solution to the treatment solution continuously and in sufficiently large amounts, said bath solution already containing the substances in their operating concentration, and also by simultaneous bath overflow. Two alternative methods are described. According to one of them, the concentration of a key component is determined using analytical methods and the supply of fresh treatment solution is regulated in accordance with the measured quantity. According to the other method, the regeneration of fresh treatment solution is controlled in accordance with the surface area of the items to be treated per unit of time as it passes through the bath.

The replacement stops the substances in the processing bath building up, in an unattainable ideal situation. Similarly, no ageing of the effective substances in the bath should take place either. The bath is in this way always kept nearly fresh. As a result, a long serviceable life and a high degree of throughput of surface area in the items to be treated, relative to the bath volume, should result.

The advantages mentioned are achieved in that fairly large quantities of liquid are passed through the treatment bath. The supplied quantity of liquid leads to a constant bath overflow. The quantity of overflow must be disposed of or, in a favourable situation, it can be used also for a further application at other stages of the procedure. Despite the high cost of disposal, this type of supplementation in practice represents a better alternative in chemically critical processes.

According to known methods, the supplement of fresh bath solution must be determined by the parameters influencing the bath volume, namely bath overflow, the insertion and removal of the item and evaporation. This is only achieved in an unsatisfactory manner because of the inexact overflow technique. For example, evaporation losses and the removal reduce the bath overflow if the latter is not counteracted by the possibility of liquid being entrained; the submerged item to be treated on the other hand displaces bath solution into the overflow. Adding of treatment solution and uncontrolled discharge of the solution out of the processing bath leads to the fact that the substance concentrations in the treatment solution cannot be exactly maintained. Hence the processing solution here must also be completely replaced after a very short period of time. Thus, when using units for circuit board technology, a serviceable life of roughly only a month is achieved.

For that reason, the problem underlying the present invention is to avoid the disadvantages of the known methods and in particular to present a method which makes possible a considerably longer serviceable life for the treatment liquid and in which method the concentration of substances in the processing liquid can be kept constant during the serviceable life.

The object is achieved by the method according to the present invention.

The object is achieved by a method for maintaining constant concentrations of substances contained in an electrolytic treatment bath where fresh treatment liquid is continually added to the treatment bath in which a permanently adjustable volume flow of treatment liquid (volume of liquid per unit of time) is removed from the treatment bath continuously or intermittently by means of appropriate devices and this volume flow remains at a constant ratio to the volume flow of the added fresh treatment liquid.

The quantity of supplied fresh treatment solution is thereby independent of the quantity of evaporated treatment liquid and also of the quantity of treatment liquid adjusted through placing the item to be treated in or out of the liquid per unit of time. Liquid losses of this type are compensated for also independently of the liquid replacement according to the invention.

Because of the continuous removal of defined quantities of liquid in which active substances and decomposition products are contained in the operating concentration which is pre-set in the treatment solution, the chemical processing parameters remain constant over a long period of time. The application of the method according to the invention leads to an extension of the serviceable life of baths by up to a year in circuit board technology. In particular, this method makes sense when using horizontal throughput units, since in this case many circuit boards are treated per unit of time with small volumes of liquid.

The replacement quantity per unit of time is open to choice as long as it does not go below a minimum amount based on consumption. Beneath this value, decomposition products in the treatment solution build up too much or the concentrations of active substances cannot be maintained. The replacement quantity is therefore, in a technically simple manner, adapted to the parameters of the method. Therefore, it is possible to run the bath precisely even over a long period of time without departing from the parameter range characterising the method.

According to the invention, the amount removed from the bath solution is set at a constant ratio to the supplied amount of treatment solution. The ratio is set preferably at 1:1. A constant withdrawal of bath solution corresponds preferably to a negative quantity of the added quantity of liquid.

In addition to the fresh bath treatment solution, further volumes of liquid are added in parallel to the bath liquid, for example for balancing the losses caused by evaporation of the treatment solution, and are in fact unaffected by said losses.

Furthermore, with additional metering devices further bath solution can be regenerated as compensation for the treatment liquid removed from the bath when the item to be treated is taken out. However the possibility also exists of using the metering devices for this purpose which serve for adding fresh treatment solution according to the invention. In this case then, the quantities of treatment liquid which are removed and added are different. In each case however, the conveying of the stream of liquid which is based on consumption is not changed as a result when treatment liquid is withdrawn.

The regeneration quantities, which depend upon the throughput, need to be determined separately for the liquid losses caused by the removal of the item to be treated. With appropriate computer control, the volumes of fresh treatment solution to be regenerated can be calculated depending upon the quantity of items to be treated passing through.

The concentrations of active substances in the fresh treatment liquid are preferably higher than their corresponding concentrations in the treatment bath. As a result, the additional loss of substances in the treatment liquid when the item is removed and the substance depletion caused by treating the item to be treated can be balanced out.

The points at which the treatment liquid is removed from and added to the treatment container containing the bath are provided preferably at different places in the bath container, in order to prevent the liquid being removed again immediately without being further mixed with the liquid contained in the container. A further possible means of preventing this consists in removing and adding the liquid at intervals, the timings for removal and supplying following one another temporally. As a result, the supplied liquid may be mixed with the treatment liquid in the bath container before the subsequent removal cycle.

The evaporation losses can be compensated for separately by adding pure solvent, in most cases by adding water. For this purpose, first of all fresh treatment solution is added on the one hand depending upon the volume stream of liquid removed. Then the level of liquid in the treatment container can be kept constant by adding water to balance out the evaporation losses. Another possibility consists of determining the evaporation losses in separate tests. Pure water is then used for regeneration corresponding to the thus determined loss rates.

The volume losses caused by removing items is generally compensated for by insertion of items. If the item to be treated is introduced in a dry state into the aqueous solution, then the removal losses are compensated for with fresh treatment liquid for example.

Known metering methods may be applied in order to realise the invention. A metering pump respectively may thus be used for removal and addition. The metering quantities are set preferably at exactly the same amount. The amounts themselves which are used per unit of time are dependent upon consumption. Other ratios of removal quantity and addition quantity may also be set.

Furthermore, it is possible to apply a measuring bowl method for removing and adding the treatment solution. For this purpose measuring bowls for example with a volume of one liter are filled and emptied again. A measuring bowl for removing or adding treatment liquid can be filled with additional pumps or pumps already present. Likewise, treatment liquid can be supplied via pumps or via valves into the bath container. By applying the measuring bowl method, expensive metering pumps are unnecessary. A combination of metering pump and measuring bowls is also possible.

What is claimed is:

1. Method for maintaining constant concentrations of substances contained in an electrolytic treatment bath comprising the steps of continually adding fresh treatment liquid containing the active substances consumed during electrolytic treatment to the treatment bath, the amount of treatment liquid added being selected to maintain a preselected concentration of active substances in the electrolytic treatment bath and being independent of the quantity of treatment liquid lost through evaporation and removal of treated items: and draining a defined adjustable volume flow of treatment liquid from the treatment bath continuously or intermittently, without the liquid overflowing from the bath because of an increase in its volume, and this defined adjustable volume flow being set at a constant ratio to the volume flow of the added fresh treatment liquid.

2. Method according to claim 1, characterized in that the volume flows of drained treatment liquid and of fresh treatment liquid added to the treatment bath are set at the same size.

3. Method according to one of claim 1 or 2, characterized in that a decrease in the volume of the bath occurring by evaporation out of the treatment bath is compensated for by adding a solvent contained in the treatment liquid without dissolved substances.

4. Method according to one of claim 1 or 2 characterized in that the concentration of active substances in the fresh treatment liquid is set higher than its concentration in the treatment bath.

5. Method according to one of claim 1 or 2 characterized in that the fresh treatment liquid is put into a treatment container and the treatment liquid is drained from the container, the liquid being added and drained at various points of the container.

6. Method according to one of claim 1 or 2, characterized in that the volume flow of the added fresh treatment liquid is increased by the amount of an additional volume flow which corresponds to a loss of treatment fluid caused by removal from the treatment bath when an item to be treated is passed through the treatment liquid.

7. Method according to one of claim 1 or 2, characterized in that metering pumps are used for removing and for adding the treatment liquid.

* * * * *